US008441156B2

(12) United States Patent
Boss et al.

(10) Patent No.: US 8,441,156 B2
(45) Date of Patent: May 14, 2013

(54) ELECTRICALLY CONDUCTIVE MODULE

(75) Inventors: Daniel Boss, Lake Villa, IL (US); Scott Qualls, Chicago, IL (US); Terrance Z. Kaiserman, Loxahatchee, FL (US); Keith J. Margolin, West Palm Beach, FL (US); Michael Wassief, Boynton Beach, FL (US); Liang Chai, Stuart, FL (US)

(73) Assignee: T-Ink, Inc., New York, NY (US)

( * ) Notice: Subject to any disclaimer, the term of this patent is extended or adjusted under 35 U.S.C. 154(b) by 686 days.

(21) Appl. No.: 12/552,502

(22) Filed: Sep. 2, 2009

(65) Prior Publication Data

US 2010/0170702 A1 Jul. 8, 2010

Related U.S. Application Data

(60) Provisional application No. 61/093,796, filed on Sep. 3, 2008.

(51) Int. Cl.
*H01H 35/24* (2006.01)

(52) U.S. Cl.
USPC ..... 307/147

(58) Field of Classification Search ..... 52/302.1, 52/302.3, 220.1–220.8, 506.06, 506.07, 173.1; 439/118, 120, 121, 147; 307/147
See application file for complete search history.

(56) References Cited

U.S. PATENT DOCUMENTS

| | | | | |
|---|---|---|---|---|
| 2,669,646 A | | 2/1954 | Ford | |
| 2,964,587 A | * | 12/1960 | Minot | 174/117 A |
| 3,524,921 A | | 8/1970 | Wolf | |
| 3,622,384 A | | 11/1971 | Davey et al. | |
| 3,781,567 A | * | 12/1973 | Papsco | 307/147 |
| 4,143,931 A | | 3/1979 | Skare et al. | |
| 4,401,962 A | | 8/1983 | Su et al. | |
| 4,460,804 A | | 7/1984 | Svejkovsky | |

(Continued)

FOREIGN PATENT DOCUMENTS

| | | | |
|---|---|---|---|
| JP | 2001-068907 A | | 3/2001 |
| KR | 100209263 B1 | | 7/1999 |
| KR | 100275372 B1 | | 1/2001 |
| WO | WO 2006123335 A2 | * | 11/2006 |

OTHER PUBLICATIONS

Dow Corning Corporation, Material Safety Data Sheet, Dow Corning (R) PI-2000 Highly Conductive Silver Ink, 2005, pp. 1-9.*

(Continued)

*Primary Examiner* — Daniel Cavallari
(74) *Attorney, Agent, or Firm* — Lerner, David, Littenberg, Krumholz & Mentlik, LLP

(57) ABSTRACT

An electrically conductive module is provided. The module includes a panel configured to engage with one or more conductive structural elements. The module further includes conductive layers formed on or in the panel. Each conductive layer has a terminal configured to be in electrical communication with at least one of the conductive structural elements. In one embodiment of the present invention, a first terminal is configured to be in electrical communication with a first conductive structural element and a second terminal is configured to be in electrical communication with a second conductive structural element. In another embodiment of the present invention, both a first terminal and a second terminal are configured to be in electrical communication with a first conductive structural element. In this embodiment, the first and second terminals are respectively configured to be in electrical communication with first and second conductive portions of the first conductive structural element.

33 Claims, 2 Drawing Sheets

U.S. PATENT DOCUMENTS

| | | | | |
|---|---|---|---|---|
| 4,552,990 | A | 11/1985 | Persson et al. | |
| 5,189,412 | A | 2/1993 | Mehta et al. | |
| 6,080,935 | A | 6/2000 | Lanoue et al. | |
| 6,492,588 | B1 | 12/2002 | Grandy | |
| 6,492,595 | B2 | 12/2002 | Sexton | |
| 6,501,525 | B2 | 12/2002 | Huang et al. | |
| 6,974,913 | B2 | 12/2005 | Bahlmann et al. | |
| 7,357,884 | B2 | 4/2008 | Fujii et al. | |
| 2005/0003855 | A1 | 1/2005 | Wada et al. | |
| 2005/0109522 | A1 | 5/2005 | Ysbrand | |
| 2006/0269721 | A1 | 11/2006 | Finkel et al. | |
| 2007/0073946 | A1 | 3/2007 | Conil et al. | |
| 2008/0090431 | A1* | 4/2008 | Patterson et al. | 439/121 |
| 2008/0198584 | A1* | 8/2008 | Fouraux et al. | 362/147 |
| 2010/0126090 | A1* | 5/2010 | Liang et al. | 52/220.6 |
| 2010/0156196 | A1 | 6/2010 | Boss et al. | |
| 2010/0170616 | A1* | 7/2010 | Boss et al. | 156/71 |

OTHER PUBLICATIONS

International Search Report dated Apr. 12, 2010 and Written Opinion of the International Searching Authority dated Apr. 12, 2010 of International Application No. PCT/US2009/055684, filed Sep. 2, 2009.

International Search Report and Written Opinion for International Application No. PCT/US2009/055681 dated Mar. 31, 2010.

International Search Report and Written Opinion for corresponding International PCT Application No. PCT/US2009/055678 dated Apr. 30, 2010.

* cited by examiner

ELECTRICALLY CONDUCTIVE MODULE

This application claims the priority of U.S. Provisional Application No. 61/093,796, filed Sep. 3, 2008.

BACKGROUND OF THE INVENTION

Field of the Invention

The present invention relates generally to the field of electrically conductive modules, and more particularly to conductive modules which are engaged with one or more conductive structural elements so as to conduct electric power or signals between the one or more conductive structural elements and an electrical device, such as a light fixture, building automation system, environmental sensors/controls, sound masking system, or speaker, connected to the conductive module. In a preferred form, the conductive modules are ceiling tiles with conductive layers formed thereon, and the conductive structural elements are conductive beams of a suspended ceiling grid.

The modules could also be panels made with metal, wood, gypsum, synthetic materials, fibrous materials, mineral materials, or they could be other surfaces such as gypsum board. Such modules may be ceiling or wall panels or surfaces. Electrical conductors and wiring in houses, buildings, office furniture, office partitions, airplanes, trains, boats, motor vehicles and the like are conventionally installed in dedicated locations and terminated in standardized receptacles which are difficult to either relocate or supplement without substantial modification to the respective structure. Often, the electrical supply is not in all the locations a user would like even in new buildings, houses, or transportation equipment. Moreover, changing the layout of the electrical system is difficult using traditional wiring technology. For example, relocating a light fixture from one location in a ceiling to another will likely require an electrician to relocate and/or install new electrical wiring, structural connections, and junction box to the new location. Similarly, lighting or speaker location in a vehicle or airplane may not be adequately positioned when the seating is reconfigured, and the modification to the wiring and structural support elements is likely to be expensive and difficult. Even in new systems and buildings, relocating wiring during assembly/construction is difficult due to conventional wiring requirements. The use of conductive modules allow for greater flexibility in locating the devices, including the ability to customize the location, type, and quantity of devices to meet a users need.

SUMMARY OF THE INVENTION

In a first aspect of the invention, an electrically conductive module is provided. The module includes a panel configured to engage with one or more conductive structural elements. The module further includes conductive layers formed on or in the panel. Each conductive layer has a terminal configured to be in electrical communication with at least one of the conductive structural elements.

In a second aspect of the invention, a system is provided. The system includes one or more conductive structural elements, and a module having a panel configured to engage with the conductive structural elements. The module further includes conductive layers formed on or in the panel, wherein each conductive layer has a terminal configured to be in electrical communication with at least one of the conductive structural elements.

In one embodiment of the present invention, a first terminal is configured to be in electrical communication with a first conductive structural element and a second terminal is configured to be in electrical communication with a second conductive structural element.

In another embodiment of the present invention, both a first terminal and a second terminal are configured to be in electrical communication with a first conductive structural element. In this embodiment, the first and second terminals are respectively configured to be in electrical communication with first and second conductive portions of the first conductive structural element.

In a third aspect of the invention, a method for forming an electrically conductive module. The method includes the steps of providing a panel configured to engage with one or more conductive structural elements, and forming a plurality of conductive layers on or in the panel, wherein each conductive layer has a terminal configured to be in electrical communication with at least one of the conductive structural elements. The conductive layers may be formed using a conductive composition, preferably a conductive ink. The conductive ink preferably includes silver or copper, and is sprayed or printed on the panel to form the conductive layers.

BRIEF DESCRIPTION OF THE DRAWINGS

The features and advantages of the present invention will become more apparent from the following description of the invention taken in conjunction with the accompanying drawings, wherein like reference characters designate the same or similar parts, and wherein.

DETAILED DESCRIPTION OF THE PREFERRED EMBODIMENTS

In order to overcome some of the problems discussed above, an electrically conductive module is provided. The module includes a panel configured to engage with one or more conductive structural elements. The module further includes conductive layers formed on or in the panel. Each conductive layer has a terminal configured to be in electrical communication with at least one of the conductive structural elements.

Figure 1:
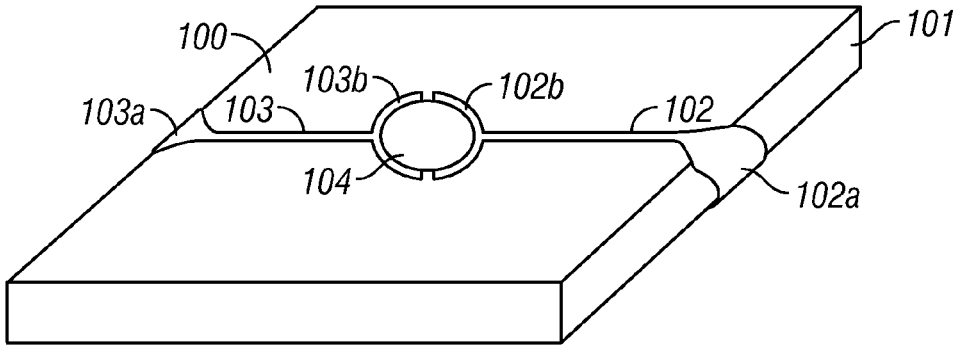
FIG. 1 shows an isometric view of an electrically conductive module having a panel (as shown here, an acoustic ceiling tile) and two conductive layers, in accordance with one embodiment of the present invention.

One exemplary embodiment of an electrically conductive module in accordance with the invention is shown in FIG. 1. In FIG. 1, the module is shown as a panel 101 having two conductive layers 102, 103 formed thereon. Alternatively, one or both conductive surfaces may be formed in the panel 101, for example, embedded below the top surface of the panel.

The panel 101 may be made of a rigid or flexible material. For example, the panel 101 may be formed as a rigid tile, such as the acoustical ceiling tile shown in FIG. 1, or a wall panel, suspended drywall ceiling panel, office partition panel, and the like. Alternatively, the panel 101 may be a flexible fabric or a covered cushion.

Figure 2:
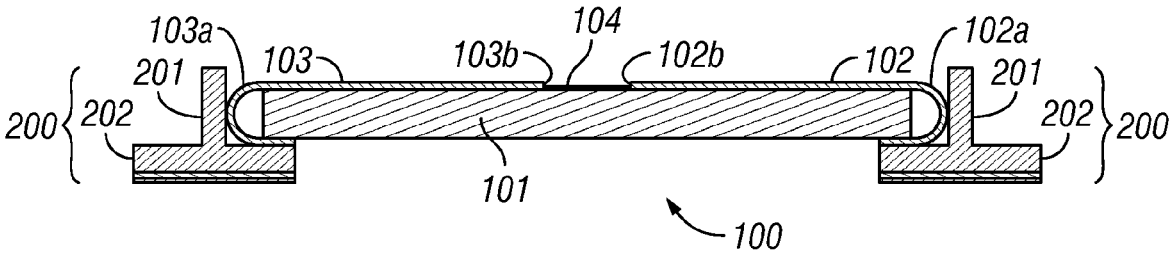
FIG. 2 shows a side view of the electrically conductive module of FIG. 1 as viewed from a front edge of the panel, engaged with and supported by two conductive structural elements (as shown here, two conductive beams of a suspended ceiling grid).

The electrically conductive module 100 is configured to engage with, and in certain circumstances be supported by, a conductive structural element. For example, FIG. 2 shows the module 100, in the form of an acoustical ceiling tile, engaged with and supported by two inverted "T"-shaped conductive members 200 of a suspended ceiling grid. The electrical conductive module 100 may be readily engaged and disengaged from the conductive structural element 200 (preferably with the power turned off to the conductive structural element), thereby permitting the conductive layers 102, 103 to be removably and non-frangibly connected to the conductive structural element 200. The engagement and disengagement may be performed by an electrician. However, in the case of acoustical ceiling tiles, this can also be done by a homeowner or superintendent.

Figure 3:
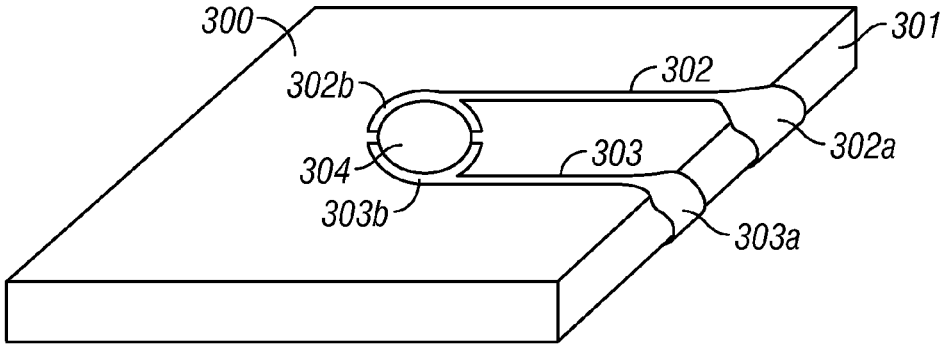
FIG. 3 shows an isometric view of an electrically conductive module having a panel (as shown here, an acoustic ceiling tile) and two conductive layers, in accordance with another embodiment of the present invention.

The panel 101 of FIG. 1 has two conductive layers 102, 103 formed thereon. Each conductive layer 102, 103 has a pair of terminals, 102*a*, 102*b* and 103*a*, 103*b*. One set of terminals 102*a*, 103*a* extends away from the panel 101 and is configured to be in electrical communication with a conductive portion of a conductive structural element, such as the conductive inverted "T" ceiling grid beam 200 shown in FIG. 2. In the module 100 shown in FIG. 1, the two terminals 102*a*, 103*a* that electrically connect to the conductive structural elements 200 respectively extend from opposing ends of the panel 101. It is within the scope of the invention to use more or less than two conductive layers and terminals (not shown). Also, the terminals 102*a*, 103*a* may be arranged to extend from the same panel end (as shown in FIG. 3), or to extend from adjoining panel ends (not shown).

The terminals 102*a*, 103*a* shown in FIG. 1, when engaged, electrically and physically contact at least a vertical web 201 of the inverted "T" beam 200 (FIG. 2), and may also electrically and physically contact a horizontal flange 202 of that beam 200. The vertical 201 and horizontal 202 portions of the beam 200 are electrically conductive and can therefore be used to conduct electrical power (AC or DC, preferably low voltage DC), or electrical analog or digital signals, such as audio or computer data. The conductive portions of the beam 200 are conductive either because of the material properties of the beam 200 itself or because a conductive layer has been applied to an otherwise non-conductive beam. For example, the conductive portion of the conductive structural element may be formed of an inherently conductive material such as steel or aluminum, or instead may be a conductor applied to at least a portion of a non-conductive structural element. Such applied conductors can include conductive coatings (including the same coatings used to form conductive layers on or in the module) or mechanically connected conductors.

In one embodiment the terminals 102*a*, 103*a* resiliently engage the conductive structural elements 200 (FIG. 2), and thereby apply a force thereto, providing suitable electrical contact for conducting electrical power or signals between the terminals 102*a*, 103*a* and the conductive structural elements 200. Moreover, such a resilient force provides physical resistance during engagement and inhibits removal of the module 100 once it is engaged. For example, as shown in FIG. 1, the terminals 102*a*, 103*a* may be formed as convex or coiled members extending from the edges of the panel 101 curving around the top and bottom surfaces of the panel 101. The ends of the terminals 102*a*, 103*a* that abut the bottom surface of the panel 101 are free to move in toward the center of the panel 101 and towards each other when they are compressed by the beams 200 (FIG. 2) during engagement of the module 100.

The module 100 shown in FIG. 1 may be engaged by positioning the module 100 above the beams 200 and positioning one of the terminals (i.e., 102*a*) between the vertical web 201 and flange 202 of one beam 200. The other terminal (i.e., 103*a*) of the module 100 can be rotated with the module 100 to engage the other beam 200 by pushing down on the module 100 as the resilient terminals compress at each end of the panel 101. The module 100 is engaged as shown in FIG. 2.

The other terminals 102*b*, 103*b* of the pairs of terminals are configured to be in electrical communication with an electrical device (not shown). As shown in FIG. 1, these terminals 102*b*, 103*b* are configured as substantially semicircular arcs which cover or abut the edges of an annular hole 104 cut into the center of the panel 101, in which hole a light fixture or speaker may be positioned and electrically connected to the two terminals 102*b*, 103*b*. Of course, it should be noted that in other embodiments the hole 104, and terminals 102*b*, 103*b*, and/or additional holes and terminals may be positioned at locations of the panel 101 other than at the center. For example, the module 100 of FIG. 1 may be formed as a ceiling tile, preferably an acoustic ceiling tile, having a light fixture or speaker mounted therein, wherein the positive and negative terminals of the light fixture or speaker respectively and electrically connect to or otherwise engage the positive and negative terminals surrounding or abutting the annular hole. In turn, the ceiling tile engages positive and negative conductive inverted "T" beams (e.g., beams 200 shown in FIG. 2) of a suspended ceiling grid.

Other electrical devices may be mounted to the panel 101, including low voltage devices, antennas, cameras, and sensors (e.g., motion, fire/smoke, and temperature), or receptacle (e.g., a power outlet or junction box) to form at least a portion of a circuit between the terminals 102*b*, 103*b*. As discussed above, the device may be a light fixture that is configured to be positioned substantially within the surface of the panel 101 and have ends which are flush with the top and bottom sides of the surface. Such a design has the advantages of conserving space in shipping and in use. For example, ceiling tiles may be manufactured configured with integrated LED lighting in similar sized packaging as is used for conventional ceiling tiles. Moreover, additional space above the ceiling beams need not be provided to house a light fixture. This may be advantageous where the ceiling height of the room is too low to install a fully suspended ceiling grid, but where such tiles could be installed in close proximity to the ceiling. Such a system may be possible by inverting the panel and the beams shown in FIG. 2 upside down such that the beam is connected to the ceiling by the horizontal flanges and the panel is engaged by pushing the panel upward between the vertical webs of the beams. It is of course to be understood that these benefits are not limited to this or any other embodiments described herein. Moreover, it is to be understood that the devices included in the circuit need not be flush with the sides of the surface and may instead extend from those surfaces a suitable distance for the intended application of the device.

In another example embodiment (not shown), the circuit includes a heating element connected on or through the surface. Such a heating element may be self regulated, controlled via an embedded controller, or connected to a remote temperature controller. In this embodiment the surface is constructed of a material that is suitable for conducting and radiating heat generated by the heating element. Such materials are suitable, for example, by not melting, burning, or deforming during the operation of the heating element. Modules 100 configured with heating elements can be engaged with conductors on walls and floors to provide radiant heating for the occupants.

In another example embodiment (not shown), the circuit can include a sensor, such as a pressure sensor. For example, the terminals 102*b*, 103*b* of module 100 sensor may be connected to a pressure sensor embedded in a flexible surface, such as a seat cushion of a vehicle, which can indicate the presence of an occupant. For example, in an automobile, such a sensor may either open or close the circuit depending on the configuration of other electrical conductors in the vehicle connected to the terminals to activate a cutoff switch connected to an airbag.

In another example embodiment (not shown), the circuit includes a receptacle or junction box, such as for routing power terminals for an electrical outlet. Such a power outlet can be used for example to connect electrical devices similarly to electrical outlets wired in occupancies, vehicles, planes, trains, etc. For example, an additional use of such an outlet can be to route power to a video monitor or digital picture frame which can be mounted on the module 100.

In another example embodiment (not shown), the circuit can include a plurality of conductors connected in parallel between the terminals so as to create a mini-grid or network either on or within the module 100. Such a mini-grid can be used, for example, to connect electrical devices to the conductors at various positions on a side of the module 100. In one embodiment where the conductors are embedded in the surface of the panel, an external device, such as a light fixture can be connected to the conductors by inserting terminals through a side of the surface to the depth where the terminals of the device contact the embedded conductors. The device may be further connected to the panel by fasteners or other connection means. By virtue of this feature electrical devices can be simply electrified by being pushed into place like a push pin into a cork board. By virtue of such a connection, panels can be manufactured with an electrical grid in or on the surface without having to include openings for devices in the surface such as hole 104 in FIG. 1. Instead, an end user can install and remove electrical devices to the panels in various locations of the panel at the point of use. This has the additional advantage of a uniform panel appearance before installation and after removal of the device. One of skill in the art will appreciate that there are other advantages of this and other embodiments described herein which are not mentioned and that those that are mentioned are not exhaustive or intended to limit the applicability of the embodiments to a specific use.

Figure 4:
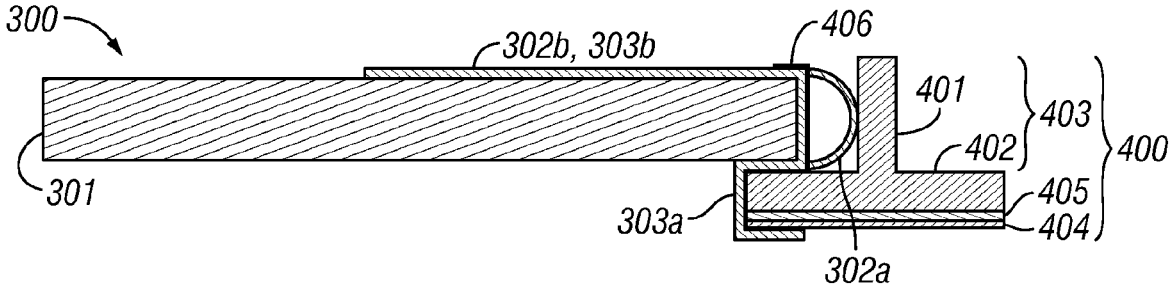
FIG. 4 shows a side view of the electrically conductive panel in FIG. 3 as viewed from a front edge of the panel, engaged with and supported by a conductive structural element (as shown here, a conductive beam, having two conductive portions, of a suspended ceiling grid).

FIG. 3 shows an example embodiment of a module 300 configured to engage a conductive structural element (400, FIG. 4). Like the panel 101 shown in FIG. 1, a panel 301 in FIG. 3 includes two conductive layers 302, 303 each having a pair of terminals 302*a*, 302*b*, and 303*a*, 303*b*, one terminal 302*a*, 303*a* of which is configured to be in electrical communication with the conductive structural element (400, FIG. 4) and the other terminal 302*b*, 303*b* of which is configured to be in electrical communication with an electrical device. As in the embodiment shown in FIG. 1, in FIG. 3 a hole 304 is located in the panel 301. Semicircular terminals 302*b*, 303*b* cover or abut the edges of the annular hole 304, similar to the terminals 102*b*, 103*b* in FIG. 1. A light fixture, speaker, or other aforementioned device may be positioned and electrically connected to the two terminals 302*b*, 303*b*, as described above with respect to those terminals 102*b*, 103*b* of module 100.

In one example embodiment, the conductive structural element is an inverted "T" ceiling grid beam, in which the first conductive portion is the metallic beam itself, and the second conductive portion is a conductive layer formed on or attached to the bottom of a horizontal flange of the beam, with an insulator separating the first and second conductive portions. This type of beam is described in U.S. patent application Ser. No. 12/552,487, entitled "Electrically Conductive Element, System, and Method of Manufacturing," filed concurrently herewith and the entire contents of which are herein incorporated by reference.

In particular, the module 300 shown in FIG. 3 has two terminals 302*a*, 303*a* extending from the same panel end, each terminal configured to connect to the same conductive structural element 400, as shown in FIG. 4. One of these terminals 302*a*, 303*a* is configured to electrically communicate with a first conductive (for example, positive) portion of the conductive structural element 400, and the other terminal 302*a*, 303*a* is configured to electrically communicate with a second conductive (for example, negative) portion of the conductive structural element.

In particular, FIG. 4 shows an example of a conductive structural element 400 to which the module 300 shown in FIG. 3 may engage. The conductive element 400 includes two conductors 403, 404 separated by an insulator 405. A first conductor 404 is affixed to the bottom of the insulator 405, while a second conductor 403, in the form of an inverted "T", is affixed to the top of the insulator 405. A first terminal 303*a* is shown configured in an inverted "S" shape to wrap around the edges of both the panel 301 and a horizontal flange 402 of the conductive element, to which the first conductor 404 is attached along its lower surface. To route signals between the first conductor 404 and the second conductor 403 through the module 300, the first terminal 303*a* is insulated along one edge to prevent electrical contact between the second conductor 400 and the first terminal 303*a*. An insulator 406 is interposed between the first terminal 303*a* and the second conductor 403 by being shaped in conformance with the shape of the first terminal 303*a*. In one embodiment the insulator 406 is applied to the first 303*a* terminal, such as by coating a portion of the surface of the first terminal 303*a* with an insulating material or by physically attaching an insulator to the first terminal 303*a*. Of course other configurations are possible whereby an insulator 406 is interposed between the first terminal 303*a* and the second conductor 403 as would be appreciated by one of skill in the art, and which are taken to be within the scope of the invention. As shown in FIG. 4, the second terminal 302*a* resiliently engages, like the terminals 102*a*, 103*a* shown in FIG. 2, with a vertical conductive portion 401 and/or the flange 402 of the second conductor 403. The first terminal 303*a* engages the second conductor 404 at a lower facing side of the second conductor.

The arrangement of the terminals 302*a*, 303*a* on the panel 301 and the corresponding configuration of the conductors 403, 404 on the conductive element 400 allows for an advantageous simplification of the system shown in FIG. 2, by connecting a module 300 to a single conductive element 400, rather than two. That is, the embodiment shown in FIGS. 3 and 4, relative to the embodiment shown in FIGS. 1 and 2, only requires power or electrical signals to pass through a single beam 400. To provide mechanical stability and strength when engaging the acoustic ceiling panel (i.e. module 300) of FIG. 3 into the suspended ceiling grid, a resilient non-conductive member may be formed on one of the other panel ends, and preferably, on the end opposite that from which the two terminals 302*a*, 303*a* extend.

Such a simplified system can be especially useful in applications where it is inconvenient or unsightly to install a second conductive element Other combinations of conductive structural elements and modules may be arranged. For example, the two conductive beams 200 of FIG. 2 may be replaced by the conductive beam 400 of FIG. 4. In this example, each conductive beam 400 can be used to conduct, independent of the other, different sources of power (AC on one beam and DC on the other beam, or high voltage DC on one beam and low voltage DC on the other beam), or one beam 400 can be used to conduct power while the other beam 400 can be used to conduct signals. The electrically conducting modules 301 of FIG. 3 can be correspondingly engaged, for example, one light-mounted module 301 in electrical communication with a low voltage DC power carrying beam, and a speaker-mounted module 301 in electrical communication with an audio signal carrying beam. This example is not intended to limit the present invention, and all appropriate combinations of power, signal sources, conductive structural elements, electrically conductive modules, and/or electrical devices are intended to be encompassed within the present invention.

Furthermore, as mentioned above, by virtue of the electrically conductive module 100, 300, power can be distributed between the conductive structural element(s) to an electrical device connected to the module. As discussed above, an AC or DC power supply (not shown) may be connected across two separate conductive structure elements (See, e.g., FIG. 2) or across two conductive, electrically isolated portions (e.g., 403, 404, FIG. 4) of a single conductive structural element (See, .e.g., 400, FIG. 4).

Of course the embodiments described here in are not limited to electrical power distribution and/or transmission, and it will be appreciated that other electrical signals may be distributed and/or transmitted through the panel. For example, analog or digital signals can be generated by any known signal generator, for example, an audio system or a computer system, and distributed and/or transmitted through the conductive structural elements and module to an appropriate electrical device. In this regard, the number of conductive layers and terminals are not limited to two, but as mentioned above, can be more than two. For example, the conductive layers and terminals can be configured as a multiconductor bus to conduct a plurality of audio channels or computer signals, commensurate with the number of conductive paths on the conductive structural element and electrical device.

In addition, in the context of building panels, the electrically conductive element may be disposed between the facing and the core of the building material such as, for example, a ceiling tiles core and its facing material. The element can also be disposed between the facing material and an aesthetic coating or even directly on the exposed face of the building material. Moreover, the elements can be on the exposed or unexposed sides of the building materials or both.

A method for forming an electrically conductive module is also provided. The method includes the steps of providing a panel configured to engage with one or more conductive structural elements, and forming a plurality of conductive layers on or in the panel, wherein each conductive layer has a terminal configured to be in electrical communication with at least one of the conductive structural elements. The conductive layers may be formed using a conductive composition, preferably a conductive ink. The conductive ink preferably includes silver or copper, and is sprayed, laminated or printed on the panel to form the conductive layers.

Although the invention herein has been described with reference to particular methods and embodiments, it is to be understood that these methods and embodiments are merely illustrative of the principles and applications of the present invention. It is therefore to be understood that numerous modifications may be made to the described methods and embodiments and that other arrangements may be devised without departing from the spirit and scope of the present invention as defined by the following claims.

What is claimed is:

1. An electrically conductive module comprising:

a panel configured to engage with one or more conductive structural elements; and a plurality of conductive layers formed on or in said panel, each conductive layer having a terminal configured to be in electrical communication with at least one of said conductive structural elements, at least one of said terminals located proximate an edge of the panel and adapted to move inward away from the edge during engagement with one of said one or more structural elements.

2. The module according to claim 1, wherein a first terminal of said terminals is configured to be in electrical communication with a first conductive structural element of said one or more conductive structural elements, and a second terminal of said terminals is configured to be in electrical communication with a second conductive structural element of said one or more conductive structural elements.

3. The module according to claim 1, wherein a first terminal of said terminals is configured to be in electrical communication with a first conductive structural element of said one or more conductive structural elements, and a second terminal of said terminals is configured to be in electrical communication with the first conductive structural element.

4. The module according to claim 3, wherein the first terminal is configured to be in electrical communication with a first conductive portion of said first conductive structural element, and the second terminal is configured to be in electrical communication with a second conductive portion of said first conductive structural element.

5. The module according to claim 1, wherein each conductive layer has another terminal configured to be in electrical communication with an electrical device configured to engage with the panel.

6. The module according to claim 1, wherein the panel is rigid.

7. The module according to claim 1, wherein the panel is flexible.

8. The module according to claim 1, wherein the panel is a ceiling tile.

9. The module according to claim 1, wherein the panel is a wall panel.

10. The module according to claim 8, wherein the ceiling tile is an acoustical ceiling tile.

11. The module according to claim 1, wherein at least one of said terminals provide physical resistance during engagement of said at least one of said terminals with one of said one or more conductive structural elements.

12. The module according to claim 1, wherein each terminal further comprises a substrate upon which a portion of the corresponding conductive layer is formed.

13. The module according to claim 1, wherein said conductive layers comprise a conductive composition.

14. The module according to claim 13, wherein said conductive composition comprises a conductive ink.

15. The module according to claim 14, wherein said conductive ink comprises silver or copper.

16. The module according to claim 14, wherein said conductive ink is sprayed or printed on the panel to form the conductive layers.

17. A system comprising:

one or more conductive structural elements;

a panel having an edge, a bottom surface and a top surface and configured to engage with said one or more conductive structural elements; and a plurality of conductive layers formed on or in said panel, each conductive layer having a terminal configured to be in electrical communication with at least one of said conductive structural elements at least one of said terminals extending toward the edge of said panel and curving around the top and bottom surfaces of said panel.

18. The system according to claim 17, wherein a first terminal of said terminals is configured to be in electrical communication with a first conductive structural element of said one or more conductive structural elements, and a second terminal of said terminals is configured to be in electrical communication with a second conductive structural element of said one or more conductive structural elements.

19. The system according to claim 17, wherein a first terminal of said terminals is configured to be in electrical communication with a first conductive structural element of said one or more conductive structural elements, and a second terminal of said terminals is configured to be in electrical communication with the first conductive structural element.

20. The system according to claim 19, wherein the first terminal is configured to be in electrical communication with a first conductive portion of said first conductive structural element, and the second terminal is configured to be in electrical communication with a second conductive portion of said first conductive structural element.

21. The system according to claim 17, further comprising an electrical device configured to engage with the panel, wherein each conductive layer has another terminal configured to be in electrical communication with said electrical device.

22. The system according to claim 17, further comprising a signal source electrically connected to said one or more conductive structural elements.

23. The system according to claim 17, further comprising a power supply electrically connected to said one or more conductive structural elements.

24. The system according to claim 18, further comprising a power supply, wherein a positive side of said power supply is electrically connected to said first conductive structural element and a negative side of said power supply is electrically connected to said second conductive structural element.

25. The system according to claim 20, further comprising a power supply, wherein a positive side of said power supply is electrically connected to said first conductive portion of said first conductive structural element and a negative side of said power supply is electrically connected to said second conductive portion of said first conductive structural element.

26. The system according to claim 21, wherein said electrical device includes at least one of a heating element, a light fixture, a speaker, a sensor, a camera, and a receptacle.

27. The apparatus according to claim 17, wherein said one or more conductive structural elements includes at least one of a ceiling beam and a wall stud.

28. The apparatus according to claim 27, wherein said ceiling beam comprises a suspended ceiling grid beam.

29. A method for forming an electrically conductive module comprising the steps of:

providing a panel configured to engage with one or more conductive structural elements;

forming a plurality of conductive layers on or in said panel, each conductive layer having a terminal configured to be in electrical communication with at least one of said conductive structural elements; and forming at least one pair of terminals having a first terminal and a second terminal such that the first terminal is proximate an edge of the panel and the second terminal is coupled to the first terminal via at least one of said plurality of conductive layers on or in the panel.

30. The method according to claim 29, wherein said conductive layers are formed using a conductive composition.

31. The method according to claim 30, wherein said conductive composition comprises a conductive ink.

32. The module according to claim 31, wherein said conductive ink comprises silver or copper.

33. The module according to claim 31, wherein said conductive ink is sprayed or printed on the panel to form the conductive layers.

* * * * *